United States Patent [19]

Brown et al.

[11] 3,975,112

[45] Aug. 17, 1976

[54] APPARATUS FOR SEALING A GAS TURBINE FLOW PATH

[75] Inventors: Henry Bispham Brown, Manchester; Francis Louis DeTolla, Vernon, both of Conn.

[73] Assignee: United Technologies Corporation, Hartford, Conn.

[22] Filed: June 9, 1975

[21] Appl. No.: 585,283

[52] U.S. Cl. ..... 415/116; 415/178; 415/217

[51] Int. Cl.[2] ..... F01D 5/14

[58] Field of Search ..... 415/115, 117, 178, 217, 415/218, 116

[56] References Cited

UNITED STATES PATENTS

| | | | |
|---|---|---|---|
| 2,859,934 | 11/1958 | Halford et al. | 415/116 |
| 3,295,824 | 1/1967 | Woodwell et al. | 415/178 |
| 3,742,705 | 7/1973 | Sifford | 415/117 |
| 3,892,497 | 7/1975 | Gunderlock et al. | 415/217 |

FOREIGN PATENTS OR APPLICATIONS

| | | | |
|---|---|---|---|
| 679,916 | 9/1952 | United Kingdom | 415/178 |
| 760,884 | 11/1956 | United Kingdom | 415/217 |
| 790,854 | 2/1958 | United Kingdom | 415/217 |

*Primary Examiner*—Henry F. Raduazo
*Attorney, Agent, or Firm*—Robert C. Walker

[57] ABSTRACT

Apparatus forming a portion of the outer wall of the flow path for working medium gases in the turbine section of a gas turbine engine is disclosed. The vanes of each turbine stage are grouped into a plurality of vane clusters which are circumferentially disposed in adjacent relationship about the flow path. A shroud which surrounds the tips of the rotor blades immediately upstream of the vane clusters is segmented in integral ratio to the number of vane clusters. The gap between each pair of adjacent vane clusters is circumferentially positioned in axial alignment with one of the gaps between adjacent shroud segments.

3 Claims, 3 Drawing Figures

APPARATUS FOR SEALING A GAS TURBINE FLOW PATH

BACKGROUND OF THE INVENTION

1. Field of the Invention

This invention relates to gas turbine engines and more particularly to apparatus forming a portion of a flow path wall for the working medium gases in the turbine section of the engine.

2. Description of the Prior Art

In a gas turbine engine of the type referred to above, pressurized air and fuel are burned in a combustion chamber to add thermal energy to the gases flowing therethrough. The effluent from the chamber comprises the working medium gases and is flowed axially downstream in an annular flow path through the turbine section of the engine. A first row of nozzle guide vanes at the inlet to the turbine direct the medium gases onto a multiplicity of blades which extend radially outward from the engine rotor. An annular shroud which is supported by the turbine case surrounds the blade tips to confine the medium gases to the flow path. A second row of nozzle guide vanes is positioned axially downstream of the blades and the shroud to redirect the medium gases to a preferred course. During operation of the engine, the shroud adjusts downstream into abutting relationship with the vanes to prevent the leakage of air therebetween.

The blade tip shrouds are commonly segmented where large variations in thermal expansion between the shroud and the supporting case are expected. A circumferential gap between adjacent segments is provided to allow independent expansion of the case and the shroud segments without inducing local stresses. The number of segments comprising an individual shroud is set with regard to the expected thermal gradient in the radial direction across the segment. The temperature of the shroud during operation of the engine is normally highest adjacent the medium flow path and causes the segments to flatten from the initial arcuate geometry. Severe flattening in many constructions causes the segments to bind in their respective supporting tracks and prevents their rearward adjustment into abutting relationship with the platforms of the downstream vanes.

The vanes which are located immediately downstream of the shroud are also grouped into segments hereinafter called vane clusters. Each vane cluster comprises a plurality of vanes which are generally welded together at their platforms. The joining of two or more adjacent vanes reduces the amount of vane twisting, within the clearance required for assembly, which normally occurs as a result of thermal gradients across each vane. The number of vanes which can be joined in each cluster is limited by the stiffness of the resulting assembly which, when overly stiff, induces high thermal stresses in the vane material during operation of the engine. No correlation exists in the prior art engines between the number of shroud segments and the number of vane clusters immediately downstream thereof.

Cooling air is commonly flowable through conduits in the turbine section to prevent destructive overheating of the various turbine components and to control the diametral growth of the turbine case. One such conduit is commonly formed between the turbine case and the abutting shroud and vane platforms which are spaced radially inward therefrom. Leakage from the conduit is minimized in constructions, such as that shown in U.S. Pat. No. 3,860,358 to Cavicchi et al. entitled "Turbine Blade Tip Seal", which discourage binding of the shroud segments in their supporting tracks and permit the rearward adjustment of the individual segments into abutting relationship with the platforms of the downstream vanes.

Notwithstanding the rearward adjustment of the shroud segments substantial leakage continues to occur between the shrouds and vane platforms. Present efforts are directed toward developing improved apparatus which will further inhibit the flow of cooling air between the shroud segments and the downstream vanes.

SUMMARY OF THE INVENTION

A primary object of the present invention is to improve the performance and durability of a gas turbine engine through the judicious use of cooling air within the turbine section of the engine including reductions in the amount of cooling air which leaks into the working medium flow path between the abutting edges of an upstream blade tip shroud and a downstream vane cluster.

The present invention is predicated upon the recognition that machining tolerances for the turbine components and the thermal distortion of the components during operation of the engine inherently produce an uneven surface opposing the rearwardly adjusting shroud segments.

According to the present invention, an upstream blade tip shroud comprises a plurality of arcuate segments and a downstream nozzle comprises a plurality of vane clusters having one or more nozzle guide vanes wherein the ratio of upstream shroud segments to downstream vane clusters is a mathematical integer, and wherein the upstream end of the gap between adjacent vane clusters is axially aligned with the downstream end of one of the gaps between adjacent shroud segments.

A primary feature of the present invention is the integral ratio of blade tip shroud segments to vane clusters which permits the axial alignment of each gap between adjacent vane clusters with a corresponding gap between shroud segments. A slot at the downstream corner of each shroud segment desensitizes the assembly to misalignment and provides a conduit for the flow of cooling air to inhibit the formation of local hot spots at the juncture of the gap between the adjacent shroud segments and the downstream vane cluster. Each shroud segment is in abutting contact with a single vane cluster.

A principal advantage of the present invention is the ability of each shroud segment to seat upon a single downstream vane cluster without regard to the relative circumferential positions of the adjacent vane clusters. A shroud segment seated against a single vane cluster is assured of line contact with the vane thus maximizing the effectiveness of the seal resulting therebetween. Effective sealing between the shroud and vanes permits the reuse of cooling air supplied to the shroud.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
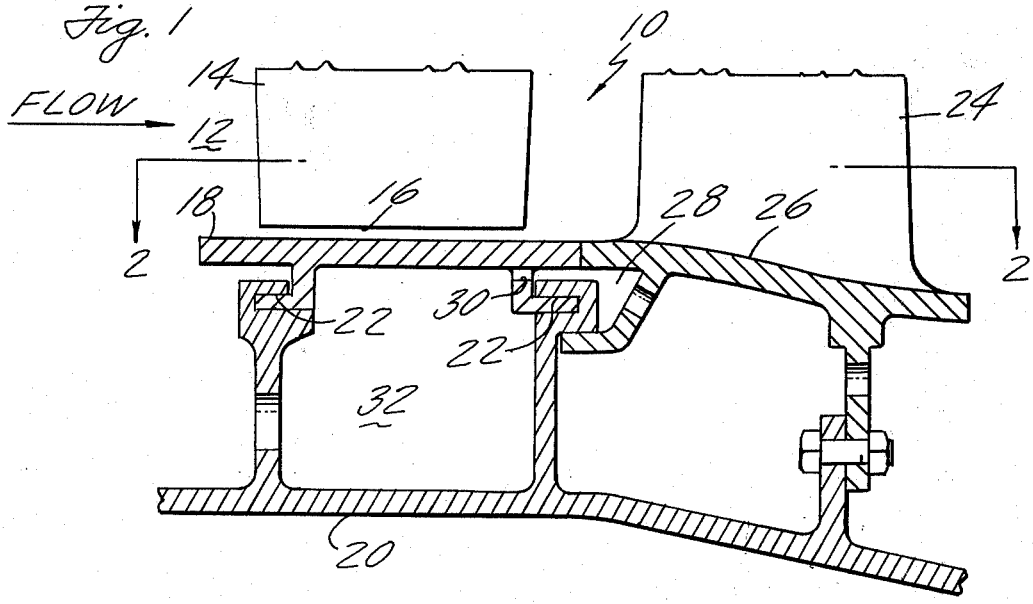
FIG. 1 is a cross section view showing a portion of the turbine section of a gas turbine engine.

A portion of a gas turbine engine having a turbine section 10 is shown in FIG. 1. The turbine section has an annular flow path 12 extending axially downstream from the combustion section of the engine which is not shown. Disposed across the flow path is a turbine blade 14 having a tip 16. A plurality of the blades 14 are spaced circumferentially about the flow path 12 at the axial location shown. A blade tip shroud 18, which is supported by the turbine case 20 in a pair of tracks 22, radially surrounds the tips 16 of the blades. A turbine vane 24 having a platform section 26 is located axially downstream from the blade 14 and is radially positioned by the case 20. A plurality of the vanes 24 are circumferentially located about the flow path 12 forming an annular chamber 28 between the vanes and the upstream shroud 18. Passages 30 in the shroud 18 communicatively join the chamber 28 to a cooling air cavity 32 which is located radially outward of the shroud.

Figure 2:
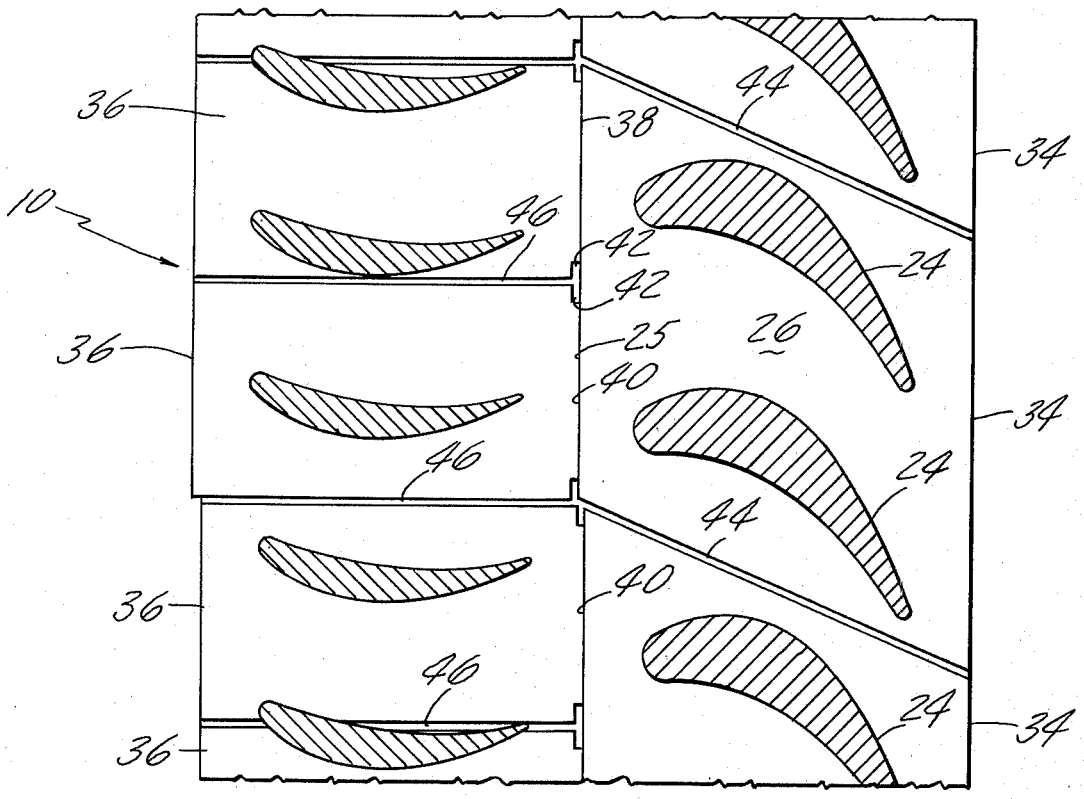
FIG. 2 is a sectional view taken along the line 2—2 as shown in FIG. 1.

As is shown in FIG. 2, a plurality of the vanes 24 are joined at their platforms 26 to form a vane cluster 34. The blade tip shroud 18 comprises a plurality of individual segments 36 each having a downstream end 38 which abuts an upstream end 40 of one of the vane clusters 34. A slot 42 extends radially through each downstream corner of the shroud segments 36. A vane gap 44 between each pair of adjacent vane clusters is in substantial axial alignment with one of the shroud gaps 46 between each pair of adjacent shroud segments.

Figure 3:
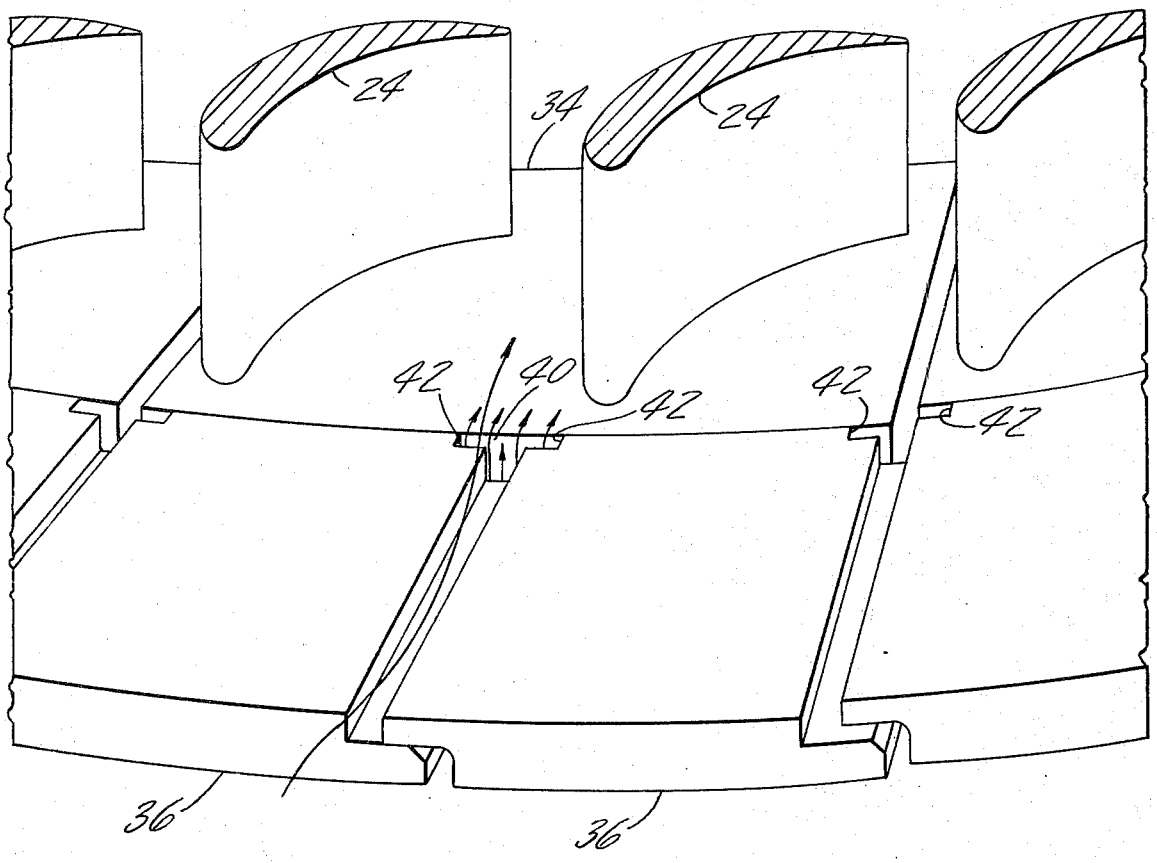
FIG. 3 is an enlarged perspective view showing the relationship of the blade tip shroud segments to the downstream vane clusters during operation of the engine.

During operation of the engine pressurized air and fuel are burned in a combustion chamber and flowed axially downstream in the flow path 12 through the turbine section of the engine. Kinetic energy is extracted from the flowing medium gases by the turbine blades 14. The medium gases downstream of the blades are redirected to a preferred course by the vanes 24 for passage through a downstream row of turbine blades. The blade tip shroud 18 radially opposes the tips 16 of the blades 14 to minimize the leakage of working medium gases across the tips. Cooling air is flowable to the cavity 32 to cool the case 20 and the shroud 18 to maintain the diameter of the shroud at a value which closely approximates the diameter circumscribed by the revolving blade tips 16. The pressure of the working medium gases is greater at the upstream end of the shroud 18 than at the downstream end. Responsively, the segments 36 which comprise the shroud adjust rearwardly into abutting relationship with the upstream ends 40 of the downstream vane clusters. The minimum number of shroud segments is determined by the anticipated thermal conditions as discussed in the Prior Art section. Summarily, the circumferential length of each segment must be less than that length which will bind within the supporting tracks 22 under severe thermal gradient conditions. The actual number of segments utilized in this preferred embodiment is increased from the discussed minimum to a number which bears a mathematically integral relationship to the number of downstream vane clusters. In one specific embodiment, 40 shroud segments abut 20 vane clusters of 2 vanes each for an integral relationship of 2. At a downstream stage of the same engine, 32 shroud segments abut 32 vane clusters of 3 vanes each for an integral relationship of 1. As is shown in FIGS. 2 and 3, the shroud segments and the vane clusters 34 are circumferentially disposed about the flow path 12 with each vane gap 44 in axial alignment with one of the shroud gaps 46. Inasmuch as the numbers of shroud segments and clusters are integrally related, each of the remaining vane gaps 44 is also in alignment with a corresponding shroud gap 46 thereby minimizing the leakage between the segments and the clusters by insuring that each shroud segment 36 abuts a single downstream vane cluster 34 in line contact at the upstream end 40 of the cluster. Hot medium gases flow axially through each shroud gap 46 from the region of relatively high pressure at the upstream end of the shroud to the region of relatively low pressure at the downstream end of the shroud as is illustrated in the FIG. 3 perspective view. The medium gases in the gap 46 strike the upstream end 40 of the adjacent vane cluster producing a local hot spot at which deterioration of the vane material becomes accelerated. The radially extending slots 42 at the downstream corner of each shroud segment 36 are in gas communication with the annular chamber 28. Cooling air is flowable through the slots 42 to cool the upstream end 40 of each vane cluster in the region of the shroud gap 46 controlling the temperature of the material at the local hot spots. The radially extending slots 42 further reduce the sensitivity of the construction to misalignment between the shroud segments and the downstream vane clusters to insure that each shroud segment seats independently upon a single downstream vane cluster.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. In a gas turbine engine of the type having a coolable blade tip shroud comprising a plurality of shroud segments including a gap between each pair of adjacent segments, and having a plurality of vane clusters positioned axially downstream of the shroud including a gap between each pair of adjacent clusters, the shroud segments being rearwardly adjustable with respect to the vane clusters to inhibit the leakage of cooling medium therebetween, wherein the improvement comprises:

a plurality of the shroud segments the number of which is in integral relationship with the number of of vane clusters and wherein the gap between each pair of adjacent vane clusters is in substantial alignment with one of the gaps between adjacent shroud segments.

2. The invention according to claim 1 wherein each shroud segment has a downstream edge including a slot in each corner thereof which insures that the downstream edge of each segment abuts a single corresponding vane cluster under conditions of limited axial misalignment between the cluster gaps and the shroud segment gaps.

3. The invention according to claim 2 wherein cooling air is flowable through the slot in each downstream corner of the shroud segments to control the local temperature of each vane cluster immediately downstream of the shroud gaps.

* * * * *